United States Patent [19]

Wentz

[11] 4,380,834

[45] Apr. 26, 1983

[54] POP-UP PLUNGER

[76] Inventor: Frederick E. Wentz, 647 North Street, Emmaus, Pa. 18049

[21] Appl. No.: 364,195

[22] Filed: Mar. 31, 1982

Related U.S. Application Data

[63] Continuation-in-part of Ser. No. 163,345, Jan. 26, 1980, abandoned.

[51] Int. Cl.[3] ..... A47K 1/14; E03C 1/26

[52] U.S. Cl. ..... 4/287; 4/286; 4/292; 4/295

[58] Field of Search ..... 4/286, 287, 292, 295, 4/191, 192

[56] References Cited

U.S. PATENT DOCUMENTS

| | | | |
|---|---|---|---|
| 1,203,530 | 10/1916 | Gessler | 4/286 |
| 1,770,639 | 7/1930 | West et al. | 4/286 |
| 2,075,443 | 3/1937 | Kirschner et al. | 4/287 |
| 2,190,278 | 2/1940 | Weidoff | 4/287 |
| 2,481,312 | 9/1949 | Kirschner | 4/287 |
| 3,018,489 | 1/1962 | Saflarski | 4/295 X |
| 3,665,526 | 5/1972 | Hoffman | 4/287 |
| 3,972,078 | 8/1976 | Maki | 4/295 X |

*Primary Examiner*—Henry K. Artis

*Attorney, Agent, or Firm*—Dann, Dorfman, Herrell and Skillman

[57] ABSTRACT

A pop-up plunger for selectively closing a generally cylindrical waste drain pipe having a seat at one end and a closure actuator remote from the seat, the plunger comprises a head portion including sealing means for engaging the seat for closing the waste drain pipe. The plunger also includes a support portion which extends from the head portion into the waste drain pipe. The support portion engages the closure actuator for axial displacement of the plunger relative to the waste drain pipe for opening and closing the waste drain pipe and includes guide means projecting into close proximity to the waste drain pipe for guiding the axial displacement of the plunger. The guide means provides at least one drain passage past the plunger to afford communication from the seat to a drain through the waste drain pipe. A hollow cylindrical foramenous sleeve member is releasably mounted on the guide means to cover the drain passage and to fill the space between the guide means and the inner surface of the waste drain pipe adjacent to the seat. The openings of the sleeve member afford a flow of waste liquid therethrough but block the passage of discrete articles. The sleeve member is held captive between the head and shoulders on the support and may be removed by disengagement of the head from the support while it remains coupled to the closure actuator.

6 Claims, 5 Drawing Figures

POP-UP PLUNGER

RELATED BACKGROUND

This application is a continuation-in-part of my prior application, Ser. No. 163,345 filed Jan. 26, 1980, now abandoned.

BACKGROUND OF THE INVENTION

This invention relates generally to drain closures and, more particularly, to a pop-up plunger for selectively closing a waste drain pipe.

DESCRIPTION OF THE PRIOR ART

Although there exists a large variety of pop-up plungers which may be employed for selectively closing a waste drain pipe, for example in a bathroom lavatory or sink, all such plungers suffer from a common problem. All such extant plungers have been designed and constructed to freely and quickly pass into the waste drain pipe waste liquids, and, as a result, they also pass hair and any other small articles which appear in the vicinity of the plunger when it is in the up or open position. While such prior art plungers are relatively effective in quickly passing liquid waste while avoiding clogs, when in the up or open position, they often pass relatively expensive discrete articles, such as contact lenses or small pieces of jewelry which are accidentally dropped into the lavatory, much to the distress of the owner of the article. Once such articles, especially contact lenses, have passed through the drain and into the waste drain pipe, recovery is extremely doubtful and can be difficult and expensive. While the loss of such articles can be avoided by simply placing the plunger in the down or closed position to seal off the drain, such action is rarely contemplated prior to the loss of such an article down the drain.

Prior devices for avoiding the loss of articles down the drain have included specially-designed strainers which are fitted into the drain and permit normal operation of the plunger, but such devices frequently become clogged and must be extracted from the drain to permit cleaning. Another device, as shown in U.S. Pat. No. 3,972,078, was designed to cooperate with a specially-designed plunger to surround the drain opening when the plunger was elevated and to retract within the drain when the plunger is closed. The operative element of such device is a coil spring which relies on the inherent spring bias to operate as set forth. Such device is believed not to be effective in actual use.

It is therefore an object of the present invention to provide an improved pop-up plunger for selectively closing a waste drain pipe which effectively prevents the entry of discrete articles into the waste drain pipe when the plunger is in the up or open position, is readily cleaned and operates efficiently and effectively for prolonged periods of use.

It is another object of the present invention to provide such a pop-up plunger which is relatively inexpensive to produce and easy to install.

It is a further object of the present invention to provide such a pop-up plunger which is readily adaptable for installation into existing waste drain systems.

SUMMARY OF THE INVENTION

Briefly stated, the foregoing objects, as well as additional objects and advantages which will become apparent from the following detailed description and the appended drawings and claims, are accomplished by the present invention which provides a pop-up plunger for selectively closing a generally cylindrical waste drain pipe having a seat at one end and a closure actuator means remote from the seat. The plunger comprises a head portion including sealing means for engaging the waste drain pipe seat area for closure thereof. A support portion extends from the underside of the head portion and into the waste drain pipe to engage the actuator means which opens and closes the waste drain pipe. The support portion includes guide means projecting into close proximity to the interior of the waste drain pipe. The guide means provides at least one drain passage past the plunger to afford communication from the seat to a drain through the waste drain pipe. In accordance with the invention, a hollow cylindrical foramenous sleeve member is removably mounted on the guide means to cover the drain passage adjacent to the head portion of the plunger. The sleeve member fills the space between the guide means and the inner surface of the waste drain pipe adjacent the seat. The openings in the sleeve member afford a flow of waste liquid therethrough but block passage of discrete articles therethrough. Removal of the sleeve member may be effected by removing the head from the support and telescopically disengaging the sleeve while the support is installed within the drain passage.

BRIEF DESCRIPTION OF THE DRAWINGS

The foregoing summary, as well as the following detailed description of several embodiments of the invention will be better understood when read in conjunction with the appended drawings, in which.

DESCRIPTION OF THE PREFERRED EMBODIMENTS

Figure 1:
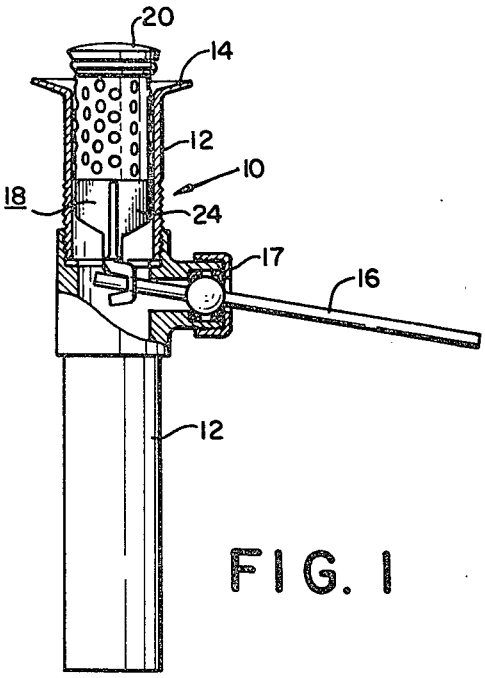
FIG.1 is a front elevational view, partially in section, of a lavatory waste drain system including one embodiment of the present invention.

Referring to FIG. 1, there is shown a portion of a waste drain system (shown generally as 10) as may be commonly installed in a typical bathroom lavatory or sink (not shown) and which includes, in one form, the present invention. The waste drain system 10 includes a generally cylindrical waste drain pipe 12. One end of the waste drain pipe 12 is connected as a drain through a suitable trap (not shown) and additional piping (not shown) to a waste disposal system, for example a septic system or the like. The other end of the waste drain pipe is adapted for installation within a suitable opening in a lavatory (not shown) and includes a generally enlarged-diameter flange which establishes an annular seat 14. The waste drain pipe further includes a suitable closure actuator means, for example a lever type actuator 16 pivoted within suitable bushings 17 within the waste drain pipe 12 for selectively opening and closing the waste drain pipe 12 in a manner hereinafter to be described.

In order to provide for controlling the lavatory end of the waste drain pipe 12, for example to close the drain in order to retain water in the lavatory for washing, a pop-up plunger 18 is installed therein as shown. The plunger 18 includes a generally circular head portion 20 having a diameter slightly larger than that of the waste drain pipe 12. The head portion 20 includes a sealing means, for example, an o-ring 22 mounted on the undersurface to engage the annular seat 14 and operate as a valve element providing a watertight seal. In FIG. 1, the plunger 18 is in the "up" or open position. By pivoting the actuator 16 upwardly, or counterclockwise in the bushing 17, the plunger 18 moves axially downwardly into the waste drain pipe 12 until the sealing element 22 engages the annular waste drain pipe seat 14 to provide a positive drain pipe seal. To open the drain, downward or clockwise pivotal movement of the actuator 16 raises the plunger 18 to the position shown in FIG. 1, thereby disengaging the head portion undersurface or valve element 22 from the waste drain pipe seat 14.

Figure 2:
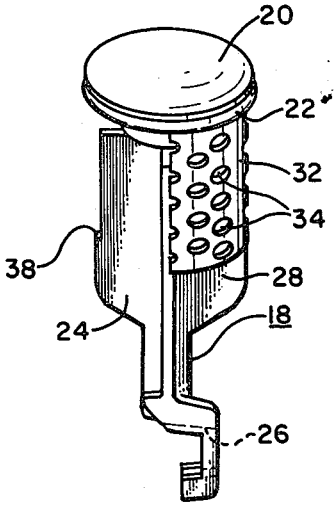
FIG. 2 is an enlarged perspective view of the plunger shown in FIG. 1.
Figure 3:
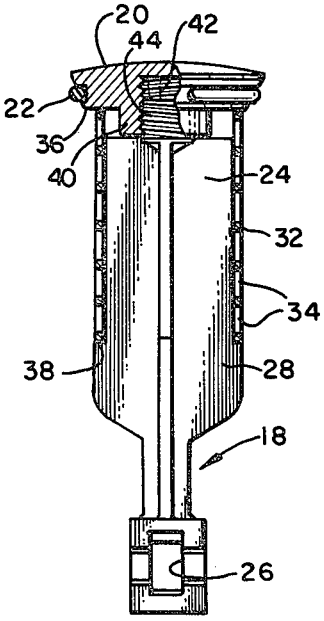
FIG. 3 is a side elevational view, partially in section, of the plunger of FIG. 2.

As shown in FIGS. 1 and 2, the plunger 18 has a support portion 24 which extends as shown from the underside of the head portion 20 and into the waste drain pipe 12. The lower end of the portion 24 includes a suitable connecting means having, for example, an eye 26, for connecting the plunger 18 with the actuator 16 as shown. As is apparent from FIG. 1, pivotal movement of the actuator 16 results in axial movement of the plunger 18 within the waste drain pipe 12.

The plunger support portion 24 also includes guide means, for example four fins 28, which may be tapered and project outwardly into close proximity to the interior wall of the waste drain pipe 12 for the purpose of guiding the plunger 18 as it is displaced axially with respect to the waste drain pipe 12. The four fins 28 are separated radially from one another to provide four separate drain passages within the waste drain pipe 12 past the plunger 18. Each of the drain passages affords fluid communication from the seat 14 past the plunger 18 and the waste drain pipe 12 to the above-described waste disposal system. To the extent described above, the plunger construction is substantially in accordance with a conventional pop-up plunger made prior to the present invention.

In accordance with the present invention, means is provided to prevent passage of descrete articles through the drain passages into the waste disposal system. To this end, the plunger 18 further includes a hollow cylindrical foramenous sleeve member 32 mounted on the outside of the fins 28 adjacent the head portion 20. The sleeve member 32 generally surrounds and covers the outer circumference of the drain passages and fills the space between the outer edges of the fins 28 and the inner surface of the waste drain pipe 12. In the present instance, the foramenous member is provided with a regular pattern of generally circular openings 34 throughout the exposed surface area of sleeve. The openings 34 in the sleeve are large enough so that when the plunger 18 is in the "up" position, a continuous flow of waste liquid may flow therethrough to the drain passages between the fins 28. However, the openings 34 are small enough to effectively prevent the entry of any discrete article, for example a contact lens or a small piece of jewelry into the drain passage. It will be appreciated that the pattern, number, size and/or the shape of the openings 34 may be varied to accommodate to the flow desired and the size of the article which is to be excluded.

The size of the outer diameter of the sleeve member 32, at least in the vicinity of the seat area 14, is important for the proper functioning of the invention. If the outer sleeve diameter is too large, the plunger 18 fits too tightly within the waste drain pipe 12 and the plunger 18 does not move freely to properly open and close the waste drain pipe 18. On the other hand, if the outer diameter of the sleeve is too small, the space between the outside of the sleeve 32 and the inside wall of the waste drain pipe 12 is large enough to pass a discrete article (such as a contact lens) and the purpose of the sleeve 32 is circumvented. Ideally, the outer diameter of the sleeve 32 should be between 0.005 of an inch and 0.020 of an inch less than the inner diameter of the waste drain pipe 12. It will be appreciated that in some applications it may be necessary to bore out or ream out the interior of the waste drain pipe 12 to provide a uniform inner surface to insure facile movement of the plunger 18.

The sleeve member 32 cooperates with an annular shoulder 36 on the underside of the plunger head portion 20. The diameter of the shoulder 36 is greater than the inner diameter of the sleeve member 32 so that the top edge of the sleeve member 32 bears on the shoulder. The fins 28 also include shoulders 38 which engage the opposite end edge of the sleeve member 32 for retaining the sleeve member 32 in place against axial displacement. Above the shoulders 38, the outer edges of the fins 28 abut the inner surface of the sleeve member 32 with a tight fit to assure coaxial alignment of the sleeve 32 on the plunger 18 and to assure proper centering of the sleeve within the waste drain pipe 12. Below the shoulders 38, the fins extend radially outward the full thickness of the sleeve so that they may bear against the interior wall of the drain. The support is preferably composed of an acetal plastic to provide ready sliding movement of the support with the drain pipe 12.

The sleeve 32 of the plunger 18 is preferably formed of bronze or brass and has a thickness so that it is not readily deformed. A thickness of 0.024" prevents inadvertent distortion of the sleeve, thereby preserving the desired clearance between the outside of the sleeve and the inside wall of the drain pipe 12.

The sleeve member cooperates with the head, the seat, and the drain pipe adjacent the seat to provide an effective barrier against the passage of discrete articles which have a size greater than the size of the openings 34 of the foramenous sleeve. After normal use of the drain, it is a simple procedure to wipe around the sleeve and thereby remove any articles or any debris such as hair, dirt particles and the like which are prevented from being discharged with the waste liquid through the drain. However, it has been found desirable to provide for a more thorough cleaning of the sleeve by removal of the sleeve entirely from the drain pipe, for example when hair or other debris entwines itself in the openings 34 and resists normal removal.

To facilitate ready removal of the sleeve 32 for cleaning, and also to facilitate assembly of the plunger, the support 18 is releasably mounted on the inside of the head portion 20 centrally within the shoulder 36. To this end the head has a boss 40 depending below the shoulder 34, the boss having a central bore 42 to releasably receive stud 44 upstanding from the intersection of the fins 28. Engagement of the stud 44 within the bore 42 interlocks the support 24 with the head 20 and captures the sleeve 32 between the shoulder 36 and the shoulders 38. Removal of the sleeve 32 may be easily accomplished by disengaging the stud 44 from the bore 42, and sliding the sleeve over the upper ends of the fins 28 off of the support 24.

It has been found desirable to permit such disengagement without removal of the plunger from the drain. Thus in accordance with the invention the bore 42 and the stud 44 are formed with complementary threads to enable threaded engagement and disengagement of the head 20 and support 24. By such arrangement, the screen may be removed from the drain without disengaging the plunger from the actuating lever. In this embodiment, the lever 16 prevents the support 24 from rotating within the drain, so that simple unscrewing of the head enables removal of the head 20 from the support 18, thereby exposing the sleeve 32 for sliding displacement upwardly from the fins 28. Once removed, the sleeve may be thoroughly cleansed of any hair or other debris which might impede the normal functioning of the drain. After cleansing, the sleeve is telescopically engaged on the fins to bear against the shoulders 38 and the head is screwed onto the stud 44 to cause the shoulder 36 to bear against the top edge of the sleeve and captivate the sleeve in place between the shoulders 36 and 38.

Figure 4:
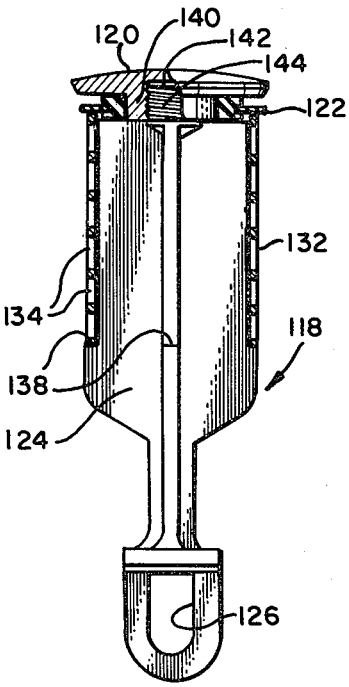
FIG. 4 is a side elevational view similar to FIG. 3 illustrating a second embodiment of the invention.
Figure 5:
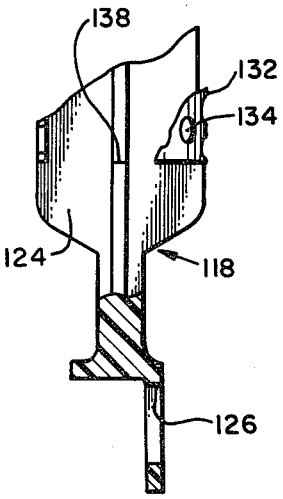
FIG. 5 is a fragment front elevation of the second embodiment of the present invention.

FIGS. 4 and 5 show an alternate embodiment of the invention in which a pop-up plunger 118 comprises a head 120, a support 124, and a sleeve 132 which cooperate similarly to the first embodiment to close the drain opening in a septic system. In this embodiment of the invention, the support 124 is similar to an existing plunger construction of conventional form, having an opening 126 in an offset foot portion of the support. A sealing element in this embodiment comprises a plastic ring 120 circumscribing a boss 140 depending from the underside of a head portion 120 of the plunger 118, and having a radilly extending sealing washer 122 of elastomeric material adapted to seal against the interior of the drain pipe at its opening into the bowl of the lavatory. The boss 140 has a threaded bore 142 to cooperate with an upstanding threaded stud 144 on the support 124 of the plunger. The support 124 has fins which engage the undersurface of the ring 120 and which have shoulders 138 which cause the sleeve 132 to be captive between the sealing flange 122 and the shoulders 138. It is apparent that the plunger 118 functions in substantially the same manner as the plunger 18.

From the foregoing description, it can be seen that the present invention provides a pop-up plunger for selectively closing a waste drain pipe which effectively prevents the entry of discrete articles into the waste drain pipe when the plunger is in the open position. It will be recognized by those skilled in the art that changes may be made to the above-described embodiments without departing from the invention. For example, pop-up plungers may be removed from existing waste drain pipes and may be suitably modified to allow for the addition of a similar foramenous sleeve member. It is understood, therefore, that this invention is not limited to the particular embodiments disclosed, but it is intended to cover all modifications which are within the scope and spirit of the invention as defined by the appended claims.

I claim:

1. A pop-up plunger for selectively closing a generally cylindrical waste drain pipe having a seat at one end and closure actuator means remote from said one end comprising:

a head portion including sealing means for engaging the seat of said waste drain pipe for closure thereof;

a support portion extending axially of said seat from one side of the head portion into the waste drain pipe and adapted for engagement with the closure actuator means to effect axial displacement of the plunger relative to the waste drain pipe for opening and closing the waste drain pipe, said shank portion having guide means projecting into close proximity to said waste drain pipe to guide said plunger for axial displacement therein, said guide means providing at least one drain passage past said plunger affording communication from said seat to a drain through said waste drain pipe; and a hollow cylindrical foramenous rigid sleeve member mounted removably on said guide means to cover said drain passage adjacent the head portion and to fill the space between said guide means and the inner surface of said waste drain pipe adjacent said seat, the openings of said formanenous sleeve member affording flow of waste liquid therethrough but blocking the passage of discrete articles therethrough, said support portion further including annular shoulder means spaced from said head portion a distance corresponding to the axial length of said sleeve member for engaging and retaining the sleeve member captive between said head and said shoulder means against axial displacement, said support portion being separable from said head portion to afford said releasable mounting of said cylindrical sleeve member between said head portion and said annular shoulder means.

2. The pop-up plunger as recited in claim 1 wherein the head portion further includes a sealing element circumscribing said head on the side confronting said support portion.

3. The pop-up plunger as recited in claims 1 or 2 wherein said separable connection between said shoulder means and said head portion comprises a threaded connection.

4. The pop-up plunger as recited in claim 3 wherein said head has a central boss depending from the side confronting said support portion, said threaded connection consisting of a threaded bore in said boss coaxial with said drain, and a threaded stud projecting axially from said support portion into said threaded bore.

5. The pop-up plunger of claim 4 wherein said support portion is of acetal plastic and has fin portions extending beyond the outer diameter of said sleeve to slide within the interior of said drain pipe.

6. The waste drain system as recited in claim 5 wherein the outside diameter of the sleeve member is less than the inside diameter of the waste drain pipe by at least 0.005 of an inch, but no more than 0.020 of an inch.

* * * * *